United States Patent [19]

Pelz

[11] 4,437,669

[45] Mar. 20, 1984

[54] GOLF PRACTICE PUTTING TRACK

[76] Inventor: David T. Pelz, 25 Tamarisk Cir., Abilene, Tex. 79606

[21] Appl. No.: 428,337

[22] Filed: Sep. 29, 1982

[51] Int. Cl.[3] ..... A63B 69/36

[52] U.S. Cl. ..... 273/186 C; 273/192

[58] Field of Search ..... 273/192, 186 C, 191 R, 273/191 A, 191 B, 183 E, 183 A, 183 R

[56] References Cited

U.S. PATENT DOCUMENTS

| | | | |
|---|---|---|---|
| 2,340,793 | 2/1944 | Chapman | 273/192 |
| 2,894,755 | 7/1959 | Scelzo | 273/192 |
| 2,992,005 | 7/1961 | Lockhart | 273/186 C |
| 3,332,688 | 7/1967 | Gevertz | 273/192 X |
| 3,899,180 | 8/1975 | Rodman | 273/192 |
| 4,334,684 | 6/1982 | Sterling | 273/192 |

FOREIGN PATENT DOCUMENTS

| | | | |
|---|---|---|---|
| 218526 | 5/1957 | Australia | 273/192 |

*Primary Examiner*—George J. Marlo
*Attorney, Agent, or Firm*—Nicholas J. Aquilino

[57] ABSTRACT

A golf putting stroke practice track contoured to follow the putter head during a putting stroke. The track includes a series of indicia which cooperate with indicia on the putter head adapted to indicate the rotational position of the putter head relative to the putting track. The rails of the track are L-shaped in cross section and are also adjustable with respect to each other in order that precise tolerances may be maintained between the putter head and the track rails so any divergence from a straight line by the putter head will result in the putter head contacting the track rails and providing an audible and tactual signal thereof.

The legs and the spacer bars of the putting track are secured in rectangular connector blocks having at least two sockets; one for a leg and a second for a spacer bar. The legs and spacer bars are easily removed from the blocks to disassemble the putting track.

4 Claims, 7 Drawing Figures

GOLF PRACTICE PUTTING TRACK

BACKGROUND OF THE INVENTION

The present invention relates to a golf practice device and, more particularly, to a putting track adapted to enable a golfer to teach himself a straight putting stroke.

It has been found that the most consistent golf putting stroke is one that is made with the golf club head moving in a straight line direction as the ball is struck by the putter. Variations in this movement, either outside or inside or to the left or right of the intended line of direction, create additional variables which must be corrected for in order that the struck ball rolls along the intended line. With the club moving at an angle with respect to the direction line, there must be a face angle correction at the point of impact in order for the ball to go straight. This correction requires specific movements in the golf putting stroke which present additional factors that require precision execution in order for the resulting ball roll to be proper. The more of these compensating variables that are present in the golf stroke, the more possibilities there are for potential errors to come into play, and produce inconsistent results.

It has also been commonly thought and taught that the best putting stroke is one that opens the club face on the backstroke, closes it to be square at impact during the downstroke, and finishes closed in the follow-through. Whereas this stroke works quite satisfactorily when all the elements are properly executed in time sequence, this type of stroke again requires precision movements in order to manipulate the club head from its open, to square, to closed positions. Under pressure situations, the more complicated the movements are, the more difficult they become to execute.

Ideally, then, the best and easiest to execute golf stroke would be one wherein the putter head moves in a straight line away from and toward the intended direction and one in which the golf club head is oriented perpendicular to this line at all times.

Some patented golf putting practice devices are described as follows: the Fletcher U.S. Pat. No. 1,545,648 shows a putter guide for golfers including a pair of raised parallel bars which are adapted to straddle the hosel of the golf club so that the club may be moved between them as the ball is struck. The Eisenberg U.S. Pat. No. 2,084,901 shows a putting device in which a putter is mechanically coupled to a roller device which rolls on a pair of parallel curved rails. The Squizo U.S. Pat. No. 2,894,755 shows a golf practice device including a pair of rails having indicia on each side; however, this indicia is used for determining the length of the stroke rather than as a reference for the position of the golf club head. The Donaldson U.S. Pat. No. 3,471,155 shows a golf training device including a pair of parallel spaced rails and a cradle member which carries the putter so that it is moved in precisely the same way every time. The Berg U.S. Pat. No. 3,572,720 shows a golf putting practice device including a U-shaped channel having side flanges with flaps of flexible material which are struck when the putter head deviates from the intended direction. The King U.S. Pat. No. 3,885,796 shows a golf putting practice apparatus including a guide member with an adjustable width slot specifically adapted to receive the head of a practice putter club.

The present invention provides a putting track which is structured so that it follows the contours of the putting stroke completely as the stroke is being made, not just at the impact position. Secondly, the track device is provided with a series of indicia which are adapted to correspond to and cooperate with indicia on the golf club head in order to determine whether the position of the golf club head is perpendicular to the intended line of flight using visual references. The putting track of the present invention includes two L-shaped elongated members which are curved or contoured so that their lowest portion is located at or near the point of impact and so that they are progressively raised towards either end from that impact position. The radius of the curvature approximates the radius of curvature of a golf putting stroke when it is properly made so that as the golfer uses the track device to practice with, the golf club head remains approximately in the same relative position with respect to the track members, both at the initial start position throughout the backstroke, the downstroke, the impact position and all the way to the follow-through position. Each of the track rails also includes a series of parallel indicia which are positioned at a 90° angle with respect to the edge of the rails, and to the theoretical perfect line of direction that the ball is to be rolled. When the track device is used with a golf club head having a line parallel to the ball striking face, it becomes visually apparent when the ball striking face is rotated open or closed with respect to the intended line of roll simply by determining whether or not the indicia on the track rails matches up or is complementary to the indicia on the golf club head.

The distance between the rails is adjustable in order that precise tolerances may be provided with respect to the putter head so that when the putter head deviates from a straight line it will hit either of the track rails providing a tactual and audible indication thereof. This is provided by means of spacer bars which adjustably connect the rails in a crosswise direction. The spacer bars and the legs of the track are adapted to fit into sockets in rectangular connector blocks which are positioned at the ends of each of the rails. The spacer bars are adjustably maintained in the connector block by means of set screws. Similarly, the legs are maintained in the connector block using set screws.

Among the objects of the present invention are the provision of an improved track putting practice device in which the golf club head is maintained at approximately the same position within the track rails throughout the putting stroke and the provision of a track-like golf club practice device wherein visual indicia on the track are designed to be complementary with corresponding indicia on the golf club head to determine the relative angular position of the two.

Another object of the present invention is to provide a golf club practice device which is easily adjustable and adapted for all types of putters.

Still a further object of the present invention is to provide a track-like golf club practice putting device which provides visual, kinesthetic, and audible indications when a golf club head moves from a prescribed desired direction.

An additional object of the present invention is the provision of an improved track putting practice device which is easily assembled and disassembled using a unique connector block structure to maintain both the legs of the device and the adjustable spacer bars.

Other objects of the invention will become apparent from the following description in conjunction with the drawings.

FIGS. *6a* and *6b* show plan views of the track of the present invention using different leg configurations.

DESCRIPTION OF THE PREFERRED EMBODIMENT

Figure 1:
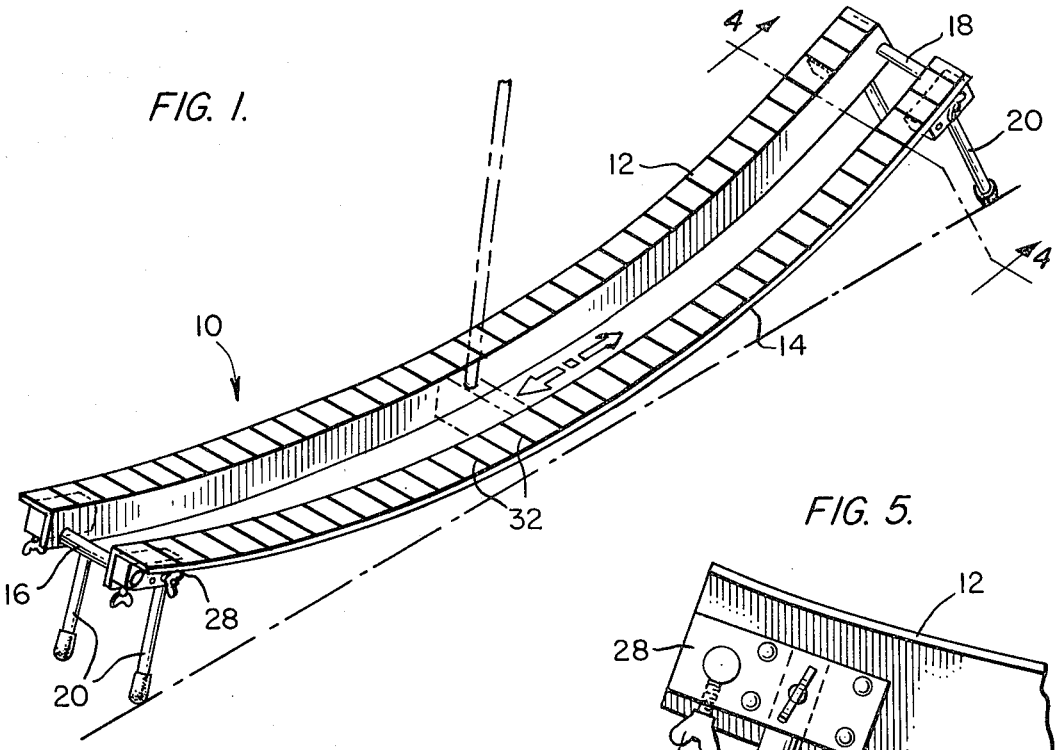
FIG. 1 is a perspective view of the present invention.
Figure 5:
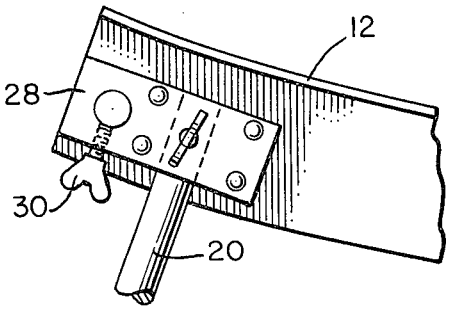
FIG. 5 is a partial view taken along lines 5—5 of FIG. 4.

FIG. 1 illustrates the golf club practice device 10 of the present invention. It includes a pair of L-shaped rail sections 12 and 14 which are adapted to be mounted parallel with each other by means of spacer bars 16 and 18 and four legs 20.

Figure 2:
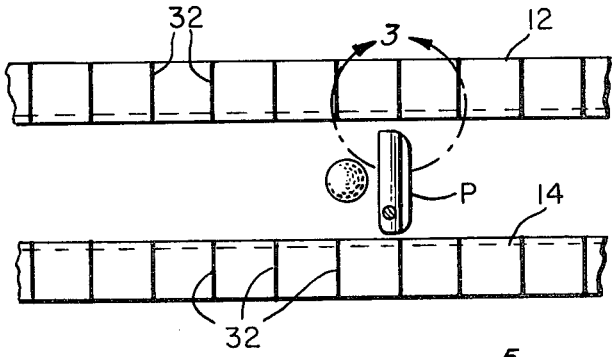
FIG. 2 is a partial top plan view of the present invention.
Figure 6A:
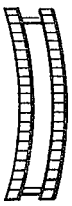
Figure 6B:
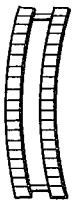
Figure 3:
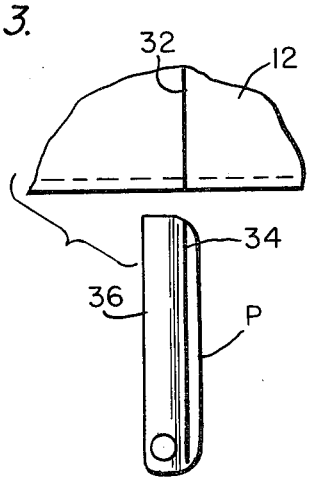
FIG. 3 is a detail of FIG. 2.
Figure 4:
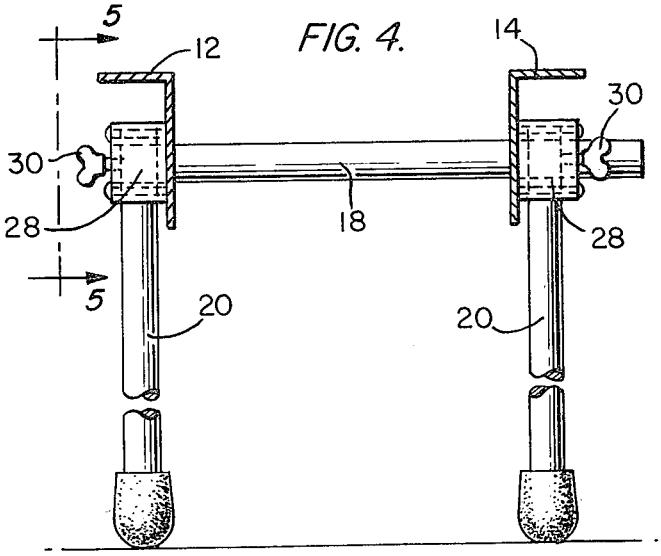
FIG. 4 is an end view partially in section taken along lines 4—4 of FIG. 1.

The legs 20 are mounted in holes or sockets in rectangular connector blocks 28 which are rigidly secured by fasteners or welds to the ends of the rails 12 and 14. The leg holes in the connector blocks 28 are accessable from the bottom so the legs, when in position in the holes, hold the rails 12 and 14 in an upright position. The connector blocks 28 include a second set of holes or sockets in their sides to accomodate the spacer bars 16 and 18. Preferably, the holes in the connector blocks on one of the rails, at least, passes completely through the blocks 28 to enable the spacer bars 16 and 18 to pass therethrough thereby enabling the rails to be adjusted nearer or further from each other depending upon the spacing wanted for the clearance of a putter head P between the rails, as shown in FIG. 2. The spacer bars 16 and 18 and the legs 20 are secured in place in the sockets in the connector blocks 28 by means of set screws 30 which may be thumb screws, allen screws or any equivalent means. The holes for the spacer bars 16 and 18 and holes for the legs are positioned at opposite ends of the connector block 28. The holes for the spacer bars are positioned in a plane perpendicular to the holes for the legs. That is, the spacer bar holes are generally parallel to the ground whereas the leg holes are generally perpendicular to the ground. The size of the legs 20 of the putting track is not critical although, preferably, the forwardmost legs would be higher because the stroke in the follow-through portion is higher above the ground than the corresponding backstroke. This will maintain the putter head P in the same position relative to the rails throughout the stroke.

Each of the rails 12 and 14 is provided with a series of indicia lines 32 which are positioned perpendicular to the edge of the rail which of course is perpendicular to the intended path of the golf ball after it is struck. The putter head P is also provided with an indicia line 34 which is parallel to its ball striking face 36 and perpendicular to the intended line or roll path of the ball. When the putter head P moves down the intended line properly between the rails, the indicia 34 on the putter head P will appear to align with the indicia lines 32 on the rails 12 and 14 appearing to create visual extensions of these lines as the putter head moves through the rails 12 and 14. If the putter head P is rotated with respect to the roll path of the ball, the indicia line 34 becomes angularly disoriented with respect to the lines 32 on the rails 12 and 14. This non-alignment becomes readily apparent visually to the golfer and provides immediate feedback of the position of the putter head P and face 36 relative to a straight path. Similarly, when the putter head P is moved away from a straight line direction as it traverses the clearance between the rails 12 and 14, the putter head P will hit the side of either of the rails 12 or 14 creating an audible, kinesthetic and visual indication that the putter head P has moved from the desired line.

Thus, in operation, a ball is placed within the putting track device and a putter is positioned directly behind it so as to be aligned perpendicular to the intended direction. As the putter head P is swung, variations beyond the preset tolerances from the intended direction will cause the putter head P to hit either of the rails 12 or 14 providing immediate indications of the deviations. Also, as the putter head P is swung, it becomes readily apparent whether or not the putter face 36 is aligned perpendicular to the intended direction by visualizing the indicia mark 34 on the putter head P relative to the marks 32 on each of the rails 12 and 14. When the putter head P moves between each of the rails 12 and 14 without hitting either of them and when the alignment mark 34 on the putter head P appears to align with each of the marks 32 on the rails 12 and 14, a perfect stroke has been made which requires no compensation in the putter face angle or putter head path to produce the desired roll of the ball. This lack of compensation and elimination of maneuvers of the putter head P during the execution of this stroke minimize potential causes of error in the putting stroke.

The putting track 10 of the present invention is particularly suited for practice of a putting stroke both indoors and outdoors because of its portability and light weight. Preferably, the rails 12 and 14 are made of light weight aluminum and the legs 20 and spacer bars 16 and 18 are removeable so the putting track may be broken down into its component parts. The putting track 10 may be precisely re-assembled and adjusted using the multi-purpose connector blocks 28 which position and maintain both the legs and spacer bars.

FIGS. *6a* and *6b* are top plan views of the putting track of the present invention using different leg configurations. As discussed hereinabove, the front legs are bigger than the rear legs. By placing both larger legs on one side of the putting track and both smaller legs on the other side of the putting track, the side with the smaller legs will be lower and the track will tilt downwardly. Because of the curved configuration of the rails, the track formed by the rails will curve inwardly or outwardly depending upon the location of the legs. In FIG. *6a* the lower legs would be on the left side of the track, whereas in FIG. *6b* the lower legs would be on the right side. The feature permits a player with a naturally curving putting stroke to use the track without having to substantially alter his putting stroke.

It will be appreciated that modifications may be made to the above-described invention in keeping within the scope of the following claims.

I claim:

1. A golf putting practice apparatus for providing a visual, audible, and tactual indication of an improper stroke comprising a putting track formed of a pair of rails, L-shaped in cross section, spaced apart forming a channel and adapted to accommodate a putter head between them, said rails being arcuate in shape, having the lowermost portion at the center of each of said rails and the uppermost portions at each of the ends thereof, the radius of curvature of said arcuate rails approximating the path of a putter head during a normal putting stroke; said rails further including a series of indicia lines on the upper surface thereof and perpendicular to the longitudinal axes of said rails, said indicia lines being adapted to cooperate with a similar indicia line on a putter head to provide a visual indication of the position of said putter head with respect to said rails during the entire putting stroke whereby deviation of the putter head from a line perpendicular to the longitudinal axis of said rails will cause the said indicia line on said putter head to be at an angle with respect to said series of indicia lines on said rails, said apparatus further including means for adjusting the position of said rails with respect to each other thereby varying the width of said channel within which said putter head is stroked so that diviations of said putter head from a straight line perpendicular to the longitudinal axis of said channel will cause said putter head to strike the side of said rails providing an audible and a tactual indication that said putter head has not followed a straight line defined by said rails.

2. The putting apparatus of claim 1 further including four supporting legs wherein one pair of said legs is longer than a second pair of said legs thereby raising one end or one side of the rails higher from the ground.

3. The apparatus of claim 2 wherein said longer legs are placed on the forwardmost position of said apparatus.

4. The apparatus of claim 2 wherein the longer of said legs are placed at one side of said putting apparatus, thereby tilting the apparatus to one side.

* * * * *